US008797366B2

(12) United States Patent
Choe et al.

(10) Patent No.: US 8,797,366 B2
(45) Date of Patent: Aug. 5, 2014

(54) METHOD OF DRIVING A LIGHT SOURCE, LIGHT SOURCE APPARATUS FOR PERFORMING THE METHOD AND DISPLAY APPARATUS HAVING THE LIGHT SOURCE APPARATUS

(75) Inventors: Weon-Jun Choe, Seoul (KR); Sang-Su Han, Seongnam-si (KR); Byung-Hyuk Shin, Seoul (KR); Yun-Jae Park, Seoul (KR)

(73) Assignee: Samsung Display Co., Ltd. (KR)

( * ) Notice: Subject to any disclaimer, the term of this patent is extended or adjusted under 35 U.S.C. 154(b) by 944 days.

(21) Appl. No.: 12/643,062

(22) Filed: Dec. 21, 2009

(65) Prior Publication Data

US 2010/0225674 A1 Sep. 9, 2010

(30) Foreign Application Priority Data

Mar. 3, 2009 (KR) ..... 10-2009-0017975

(51) Int. Cl.
*G09G 5/10* (2006.01)

(52) U.S. Cl.
USPC ..... 345/690

(58) Field of Classification Search
None
See application file for complete search history.

(56) References Cited

U.S. PATENT DOCUMENTS

| | | | | |
|---|---|---|---|---|
| 2003/0085905 | A1 | 5/2003 | Mori et al. | |
| 2007/0247415 | A1 | 10/2007 | Yasunaga | |
| 2008/0001881 | A1 * | 1/2008 | Baba et al. | 345/89 |
| 2008/0246779 | A1 | 10/2008 | Lee et al. | |
| 2008/0272999 | A1 * | 11/2008 | Kurokawa et al. | 345/89 |
| 2008/0284768 | A1 * | 11/2008 | Yoshida et al. | 345/208 |
| 2009/0033602 | A1 * | 2/2009 | Alexander et al. | 345/77 |

FOREIGN PATENT DOCUMENTS

| | | | |
|---|---|---|---|
| CN | 1379388 | A | 11/2002 |
| CN | 1964431 | A | 5/2007 |
| CN | 101019167 | A | 8/2007 |
| CN | 101127198 | A | 2/2008 |
| CN | 101281713 | A | 10/2008 |
| JP | 2004062134 | A | 2/2004 |
| JP | 2004236146 | A | 8/2004 |
| JP | 2004272275 | A | 9/2004 |
| JP | 2005079994 | A | 3/2005 |
| JP | 2005323147 | A | 11/2005 |
| JP | 2005-352269 | A | 12/2005 |
| JP | 2006-284982 | A | 10/2006 |
| JP | 2008158400 | A | 7/2008 |
| KR | 1020040075541 | A | 8/2004 |

* cited by examiner

*Primary Examiner* — Adam R Giesy
*Assistant Examiner* — Henok Heyi
(74) *Attorney, Agent, or Firm* — Cantor Colburn LLP

(57) ABSTRACT

A method of driving a light source including a light-emitting block includes generating a luminance representative value based on an average grayscale value and a maximum grayscale value extracted from an image signal corresponding to the light-emitting block. The method further includes detecting a predetermined pattern of the light-emitting block, generating a compensation control signal based on the predetermined pattern, generating a compensated luminance representative value by compensating the luminance representative value based on the compensation control signal, and driving the light-emitting block based on the luminance level of the light-emitting block corresponding to the compensated luminance representative value.

18 Claims, 9 Drawing Sheets

METHOD OF DRIVING A LIGHT SOURCE, LIGHT SOURCE APPARATUS FOR PERFORMING THE METHOD AND DISPLAY APPARATUS HAVING THE LIGHT SOURCE APPARATUS

This application claims priority to Korean Patent Application No. 2009-17975, filed on Mar. 3, 2009, and all the benefits accruing therefrom under 35 U.S.C. §119, the content of which in its entirety is herein incorporated by reference.

BACKGROUND OF THE INVENTION

1. Field of the Invention

The present invention relates to a method of driving a light source, a light source apparatus for performing the method and a display apparatus having the light source apparatus. More particularly, the present invention relates to a method of driving a light source which substantially improves a display quality, a light source apparatus for performing the method, and a display apparatus having the light source apparatus.

2. Description of the Related Art

Generally, a liquid crystal display ("LCD") apparatus includes an LCD panel that displays images by controlling a transmittance of light through liquid crystal molecules, and a backlight unit disposed under the LCD panel to provide the LCD panel with light.

The LCD panel typically includes an array substrate, a color filter substrate and a liquid crystal layer interposed between the array substrate and the color filter substrate. The array substrate includes pixel electrodes and corresponding thin-film transistors ("TFTs") electrically connected to the pixel electrodes. The color filter substrate includes a common electrode and a plurality of color filters.

When an electric field is applied to the liquid crystal layer, an alignment direction of the liquid crystal molecules in the liquid crystal layer is changed so that the transmittance of light therethrough is changed. For example, when the transmittance is at a maximum, the LCD panel displays a white image having a high luminance. In contrast, when the transmittance is at a minimum, the LCD panel displays a black image having a relatively low luminance.

Recently, in efforts to prevent a contrast ratio ("CR") of an image from decreasing, as well as to minimize power consumption, a local dimming method for a light source in the LCD apparatus has been developed. In the local dimming method, the light source is divided into a plurality of light-emitting blocks and an amount of the light from each of the light-emitting blocks is controlled based on a luminance of an image corresponding to each of the light-emitting blocks.

In addition, various local dimming modes have been developed for the driving blocks. For example, in a global-dimming mode, s an entire screen is dimmed as a driving block, while in a one-dimensional dimming mode the driving block is divided with respect to longitudinal and/or latitudinal directions, and the divided blocks are then driven.

In a two-dimensional dimming mode, the driving block is divided with respect to both the longitudinal and the latitudinal directions and the divided blocks are then driven, while in a three-way dimming mode, color information is used in addition to positional information, and the luminance of a specific image is boosted in attempts to maximize image sensitivity by applying adaptive luminance and power control ("ALPC") and other methods.

However, since the above-mentioned local dimming modes have limitations which include, but are not limited to, a requirement to drive the LCD apparatus block by block, a flickering phenomenon is generated when subtitles appear displayed images, such as in a movie. Specifically, in the global dimming mode and the boosting mode, the whole screen becomes dim or, alternatively, boosted when driving the LCD apparatus, and thus the flickering phenomenon is also generated by luminance differences between frames. In addition, in the one-dimensional dimming mode, luminance differences between blocks within a single frame are visible since a number of the blocks is relatively low compared to some other local dimming modes. Further, in the two-dimensional dimming mode, the flickering phenomenon is also generated, as is a glaring of the image, because of luminance differences between the block including the subtitles and other blocks.

However, in previous attempts to mitigate the above-mentioned deficiencies, when a number of driving blocks is increased to prevent generation of the flickering phenomenon due to the subtitles, for example, size and power requirements of a driving integrated circuit ("IC") are substantially increased. Therefore, increasing the number of driving blocks is not desirable for the global dimming mode, or the one-dimensional dimming mode, for that matter, even though these methods are generally utilized in LCD apparatuses including edge-illumination type backlights. Thus, the flickering phenomenon is not effectively prevented in such an LCD apparatus utilizing the global dimming mode and/or the boosting mode.

BRIEF SUMMARY OF THE INVENTION

Exemplary embodiments of the present invention address the above-described deficiencies and provide a method of driving a light source which substantially increases a display quality of an image by substantially reducing and/or effectively preventing a flickering phenomenon.

According to an alternative exemplary embodiment of the present invention, there is provided a light source apparatus for performing the method of driving a light source.

According to another alternative exemplary embodiment of the present invention, there is provided a display apparatus including the light source apparatus.

In an exemplary embodiment, a method of driving a light source including a light-emitting block includes generating a luminance representative value based on an average grayscale value and a maximum grayscale value extracted from an image signal corresponding to the light-emitting block. The method further includes detecting a predetermined pattern of the light-emitting block, generating a compensation control signal based on the predetermined pattern, generating a compensated luminance representative value by compensating the luminance representative value based on the compensation control signal. In the method, the light-emitting block is driven based on a luminance level of the light-emitting block corresponding to the compensated luminance representative value.

In an exemplary embodiment, the predetermined pattern is detected by comparing a difference between average grayscale values of an n-th frame and an (n−1)-th frame (where "n" is a natural number greater than or equal to 2) with a first critical value, and comparing a difference between maximum grayscale values of the n-th frame and the (n−1)-th frame with a second critical value.

In an exemplary embodiment, the predetermined pattern is further detected by comparing a difference between the average grayscale value of an m-th frame (where "m" is a natural number greater than 2), when the compensation control signal has a high level, and the average grayscale value before a transition of the compensation control signal from a low level to the high level, with the first critical value, and comparing a difference between the maximum grayscale value of the m-th frame and the maximum grayscale value when the compensation control signal transitions from the low level to the high level with the second critical value.

In an exemplary embodiment, the luminance representative value is compensated such that a rate of decrease of a luminance of the light source is less than or equal to a predetermined value. The luminance representative value may be compensated such that a luminance of the light source changes based on the average grayscale value regardless of a value of the maximum grayscale value.

In an exemplary embodiment of the present invention, a light source apparatus includes a backlight unit. The backlight unit includes a light-emitting block, and the light-emitting block includes a light source. The light source apparatus further includes a representative value determining part which generates a compensation control signal by determining a luminance representative value and by detecting a predetermined pattern based on an average grayscale value and a maximum grayscale value extracted from an image signal corresponding to the light-emitting block. The light source apparatus further includes a representative value compensating part which compensates the luminance representative value based on the compensation control signal to generate a compensated luminance representative value. The light source apparatus also includes a light source driving part which drives the light-emitting block based on a luminance level of the light-emitting block corresponding to the compensated luminance representative value.

In an exemplary embodiment, the representative value determining part includes an average value extracting part which extracts the average grayscale value from the image signal, a maximum value extracting part which extracts the maximum grayscale value from the image signal, a pattern detecting part which generates the compensation control signal by detecting the predetermined pattern based on the average grayscale value and the maximum grayscale value extracted from the image signal and a representative value computing part which computes the luminance representative value.

In an exemplary embodiment, the pattern detecting part includes a comparing part which generates the compensation control signal by comparing a difference between average grayscale values of an n-th frame and an (n−1)-th frame, and a difference between maximum grayscale values of the n-th frame and the (n−1)-th frame with a first critical value and a second critical value, respectively, a compensating part which compensates the average grayscale value and the maximum grayscale value based on the average grayscale value and the maximum grayscale value of the n-th frame and based on the compensation control signal, and a selecting part which selects and outputs the compensated average grayscale value and the maximum grayscale value based on the compensation control signal.

In an exemplary embodiment, the comparing part is configured to transition the compensation control signal from a low level to a high level and outputs the compensation control signal having the high level when the difference between the average grayscale values is less than the first critical value and the difference between the maximum grayscale values is greater than the second critical value.

In an exemplary embodiment, the representative value compensating part is configured to compensate the average grayscale value and the maximum grayscale value such that a luminance of the backlight unit changes based on the average grayscale value extracted from the image signal regardless of a value of the maximum grayscale value when the compensation control signal transitions from the low level to the high level.

In an exemplary embodiment, the comparing part is configured to transition the compensation control signal from the high level to the low level and output the compensation control signal having the low level when the difference between the average grayscale values is greater than the first critical value and the difference between the maximum grayscale value is less than the second critical value.

In an exemplary embodiment, the representative value compensating part is configured to increase an initial charging period when the compensation control signal transitions from the high level to the low level, and to buffer the luminance representative value during the initial charging period to decrease luminance of the backlight unit at a rate which is less than or equal to a predetermined value.

In an exemplary embodiment, the comparing part is configured to compare a difference between an average grayscale value of an m-th frame and the average grayscale value extracted from the image signal before the compensation control signal transitions from a low level to a high level with the first critical value, and to compare a difference between the maximum grayscale value of the m-th frame and the maximum grayscale value extracted from the image signal when the compensation control signal transitions from the low level to the high level with the second critical value when the compensation control signal has the high level, wherein m is a natural number greater than 2.

In an exemplary embodiment, the comparing part is configured to generate the compensation control signal when one of the difference between the average grayscale value of the m-th frame and the average grayscale value before the compensation control signal transitions from the low level to the high level are greater than the first critical value, and the difference between the maximum grayscale value of the m-th frame and the maximum grayscale value right before the compensation control signal transitions from the low level to the high level are less than the second critical value.

In an exemplary embodiment, the representative value compensating part is configured to increase an initial charging period when the compensation control signal transitions from the high level to the low level and buffer the luminance representative value during the initial charging period to decrease a luminance of the backlight unit at a rate which is less than or equal to a predetermined value.

In an exemplary embodiment, the pattern detecting part includes a temporary storing part which stores and outputs average grayscale values of an n-th frame and an (n−1)-th frame, and maximum grayscale values of the n-th frame and the (n−1)-th frame based on blocks or frame, a block comparing part which receives the average grayscale values and the maximum grayscale values corresponding to the light-emitting block from the temporary storing part, and which generates a block compensation control signal based on a block/frame selecting signal ("BFS"), a frame comparing part which receives the average grayscale values and the maximum grayscale values corresponding to frames from the temporary storing part, and which generates a frame compensation control signal based on the BFS, and a selecting part which selects the block compensation control signal or the frame compensation control signal based on the block/frame selecting signal, and which outputs the block compensation control signal or the frame compensation control signal.

In an exemplary embodiment of the present invention, a display apparatus includes a light source apparatus and a display unit. The light source apparatus includes a backlight unit including a light-emitting block, the light-emitting block including a light source, a representative value determining part which determines a luminance representative value based on an average grayscale value and a maximum grayscale value extracted from an image signal corresponding to the light-emitting block, which detects a predetermined pattern based on the average grayscale value and the maximum grayscale value extracted from the image signal corresponding to the light-emitting block, and which generates a compensation control signal. The light source apparatus further includes a representative value compensating part which compensates the luminance representative value in response to the compensation control signal to generate a compensated luminance representative value, and a pixel correcting part which corrects pixel data of the image signal based on the compensated luminance representative value, and a light source driving part which drives the light-emitting block based on a luminance level of the light-emitting block corresponding to the compensated luminance representative value. The display unit includes a display panel and a panel driving part which drives the display panel based on the corrected pixel data.

In an exemplary embodiment, the pixel correcting portion includes a pixel luminance determining part which computes a real luminance distribution of the image based on the compensated luminance representative value, and which determines a pixel luminance value, and a pixel data correcting part which corrects the pixel data based on the pixel luminance value determined by the pixel luminance determining part.

According to exemplary embodiments, in a method of driving a light source, a light source apparatus for performing the method and a display apparatus having the light source apparatus of the present invention, a luminance representative value is compensated based on an average grayscale value and a maximum grayscale value, thereby substantially reducing and/or effectively preventing a flickering phenomenon and substantially improving a reliability of the display apparatus.

BRIEF DESCRIPTION OF THE DRAWINGS

The above and other aspects, advantages and features of the present invention will become more apparent by describing in further detail exemplary embodiments thereof with reference to the accompanying drawings, in which.

DETAILED DESCRIPTION OF THE INVENTION

Figure 1:
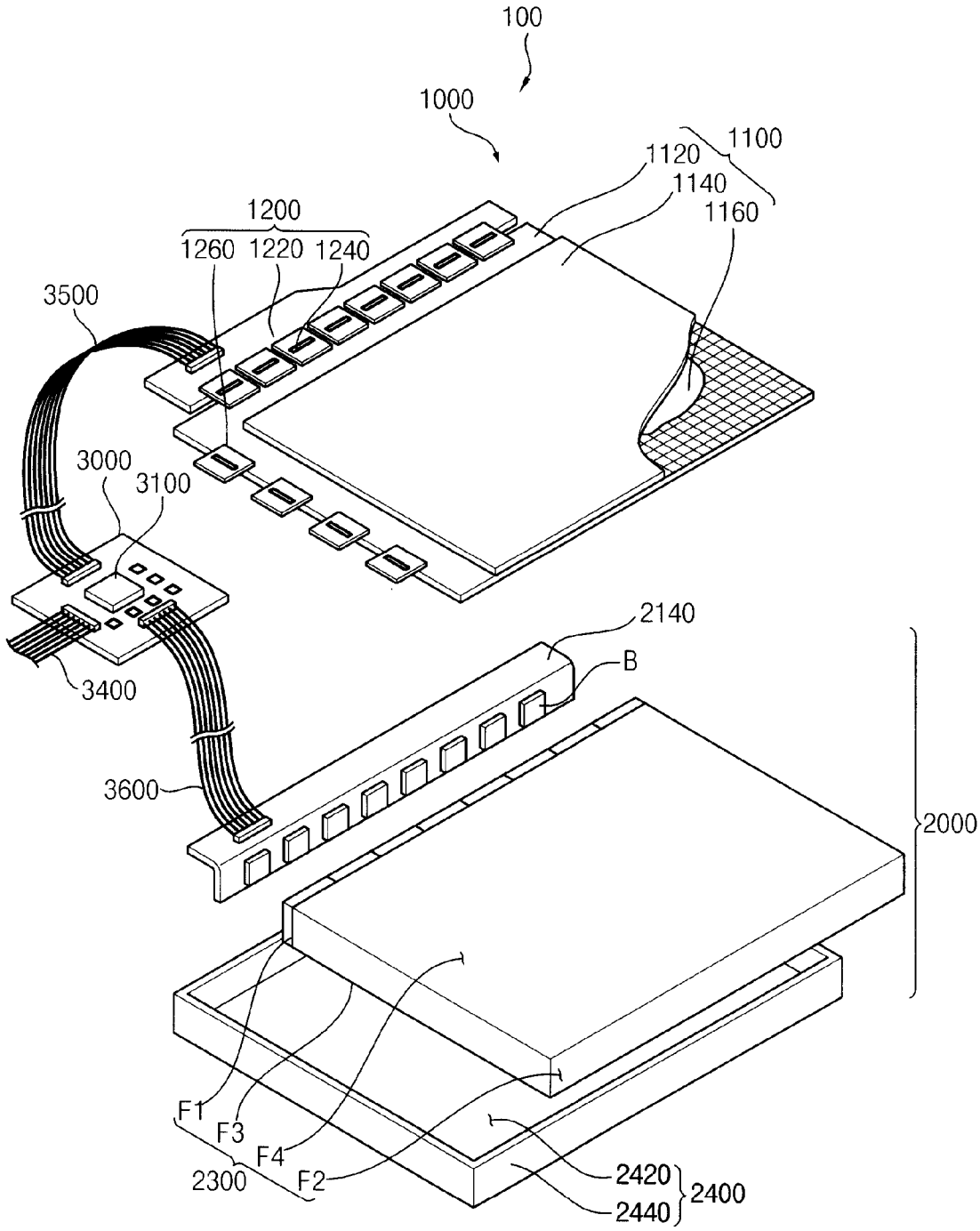
FIG. 1 is a perspective view of an exemplary embodiment of a display apparatus according to the present invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiment of the present invention will be described in further detail with reference to the accompanying drawings.

Figure 2:
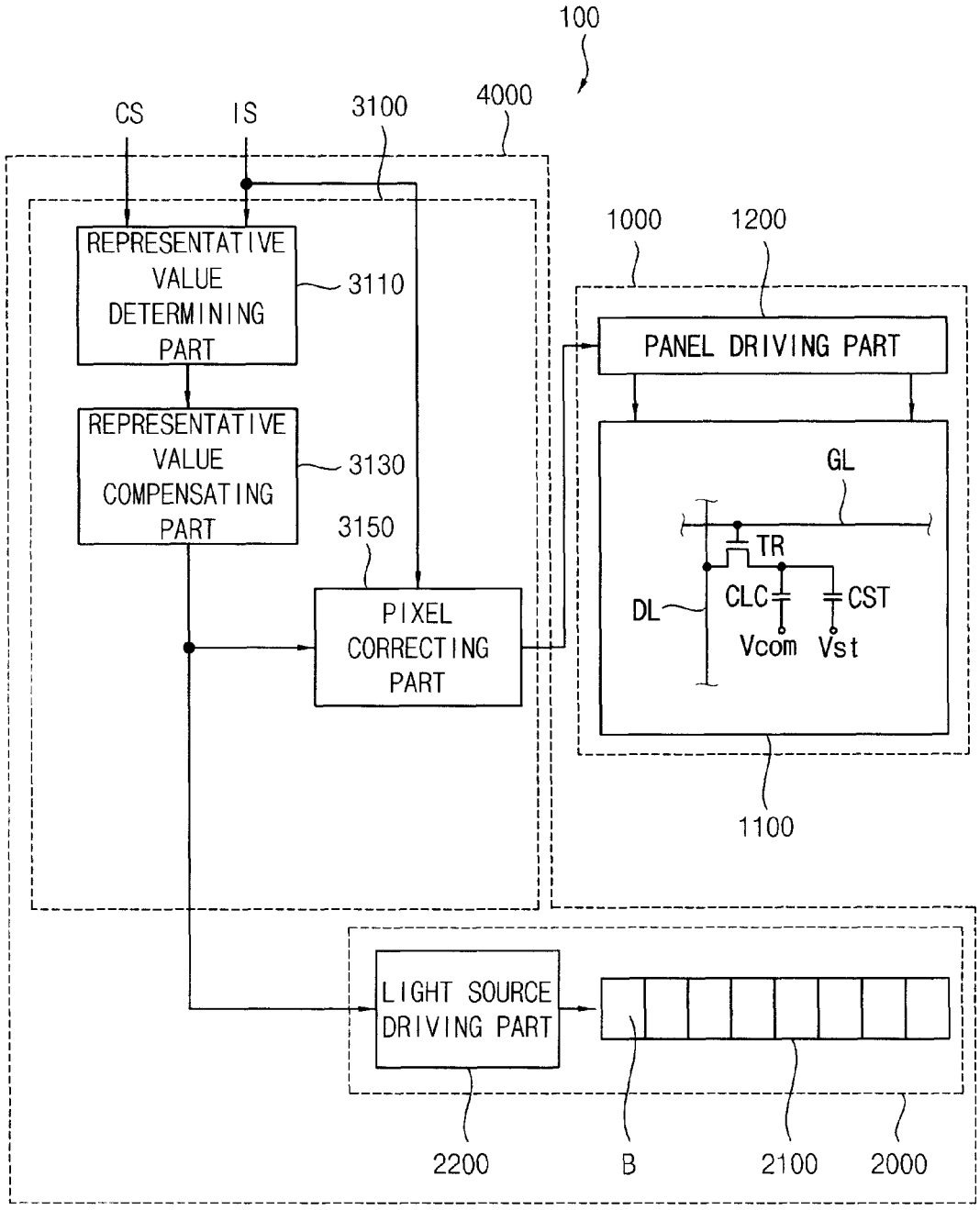
FIG. 2 is a block diagram of the display apparatus shown in FIG. 1.

FIG. 1 is a perspective view of an exemplary embodiment of a display apparatus according to the present invention. FIG. 2 is a block diagram of the display apparatus shown in FIG. 1.

Referring to FIGS. 1 and 2, a display apparatus 100 in accordance with an exemplary embodiment includes a display unit 1000, a backlight unit 2000 and a controller board 3000.

The display unit 1000 includes a display panel 1100 and a panel driving part 1200.

The display panel 1100 includes a first substrate 1120, a second substrate 1140 facing the first substrate 1120, e.g., disposed opposite to the first substrate 1120, and a liquid crystal layer 1160 disposed between the first substrate 1120 and the second substrate 1140. The first substrate 1120 includes a plurality of pixels which display an image. Each pixel includes a switching element TR connected to a gate line GL and a data line DL, a liquid crystal capacitor CLC connected to the switching element TR and a common voltage Vcom, and a storage capacitor CST connected to the switching element TR and which stores a voltage Vst.

The panel driving part 1200 includes a source printed circuit board ("PCB") 1220, a data driving circuit film 1240 connecting the source PCB 1220 with the display panel 1100, and a gate driving circuit film 1260 connected to the display panel 1100. The data driving circuit film 1240 is connected to the data lines DL, and the gate driving circuit film 1260 is connected to the gate lines GL on the first substrate 1120. The data driving circuit film 1240 and the gate driving circuit film 1260 may include a driving chip which outputs a driving signal for driving the display panel 1100 in response to, e.g., based on, a control signal provided from the source PCB 1220, for example.

The backlight unit 2000 includes a light source 2100, a light source driving part 2200, a light guide plate 2300 and a receiving container 2400. The backlight unit 2000 is disposed under the display unit 1000 and provides light to the display unit 1000. In an exemplary embodiment, the backlight unit 2000 may be an edge-illumination type backlight unit 2000 in which the light source 2100 is disposed at a side peripheral portion of the light guide plate 2300, but alternative exemplary embodiments are not limited thereto.

The light source 2100 may be a point source of light, such as a light-emitting diode ("LED"), for example. The light source 2100 is mounted on a driving substrate 2140. The driving substrate 2140 may include controlling wiring (not shown) for controlling the light source 2100 and electric power source wiring (not shown) for supplying electric power to the light source 2100. The light source 2100 may include white LEDs for emitting white light. Alternatively, the light source 2100 may include red LEDs for emitting red light, green LEDs for emitting green light and/or blue LEDs for emitting blue light.

The light source 2100 includes a plurality of light-emitting blocks B, and each light-emitting block B of the plurality of light-emitting blocks B may include at least one LED. The light-emitting blocks B may be driven by a one-dimensional local dimming mode in which the light-emitting blocks B are divided and then driven in a longitudinal direction and/or a latitudinal direction of the divided blocks.

More specifically, the light source driving part 2200 according to an exemplary embodiment determines a dimming level of each light-emitting block B using a luminance compensating value of each light-emitting block B outputted from the controller board 3000. The light source driving part 2200 drives the light-emitting blocks B by providing each light-emitting block B with the driving signals.

In an exemplary embodiment, the light guide plate 2300 is an optical plate for guiding the light outputted from the light source 2100 to an entire surface of the display panel 1100. The light guide plate 2300 according to an exemplary embodiment includes a first surface F1, a second surface F2, a third surface F3 and a fourth surface F4, as shown in FIG. 1. The first surface F1 is an incident surface F1 of the light guide plate 2300 and the third surface F3 is an emitting surface F3 of the light guide plate 2300. The second surface F2 faces the first surface F1, and a plane defined by the fourth surface F4 is substantially parallel to a plane defined by the third surface F3 and is substantially perpendicular to planes defined by the first surface F1 and the second surface F2.

The receiving container 2400 receives components such as the display unit 1000, the light source 2100 and the light guide plate 2300, for example. The receiving container 2400 includes a bottom part 2420 and side walls 2440 extending from an edge of the bottom part 2420.

In an alternative exemplary embodiment, the backlight unit 2000 may further include optical sheets (not shown) disposed between the display panel 1100 and the light guide plate 2300 to further improve optical characteristics of the display apparatus 100. More particularly, the optical sheets may include a diffusion sheet to improve a luminance uniformity of light and at least one prism sheet to increase a front luminance of the light.

The controller board 3000 is electrically connected to the display unit 1000 and the backlight unit 2000 to control the display unit 1000 and the backlight unit 2000. The controller board 3000 includes a controller unit 3100, a first connector 3400, a second connector 3500 and a third connector 3600.

The first connector 3400 is connected to an external apparatus (not shown). The first connector 3400 provides the controller unit 3100 with an image signal IS and a control signal CS received from the external apparatus. The second connector 3500 is electrically connected to the display unit 1000 to provide the display unit 1000 with the image signal IS. The third connector 3600 is electrically connected to the light source driving part 2200 of the backlight unit 2000.

The controller unit 3100 includes a representative value determining part 3110, a representative value compensating part 3130 and a pixel correcting part 3150. The representative value determining part 3110 determines a luminance representative value of each light-emitting block B from the external image signals corresponding to each light-emitting block B. The representative value compensating part 3130 compensates each luminance representative value and computes a luminance compensating value. The luminance compensating value computed by the representative value compensating part 3130 is provided to the light source driving part 2200 and the pixel correcting part 3150. The pixel correcting part 3150 corrects pixel data of the image signal IS based on the luminance compensating value. The corrected pixel data is provided to the panel driving part 1200.

The controller unit 3100 and the backlight unit 2000 are included in a light source apparatus 4000 according to an exemplary embodiment.

The controller unit 3100 will be described in further detail with reference to FIG. 3.

Figure 3:
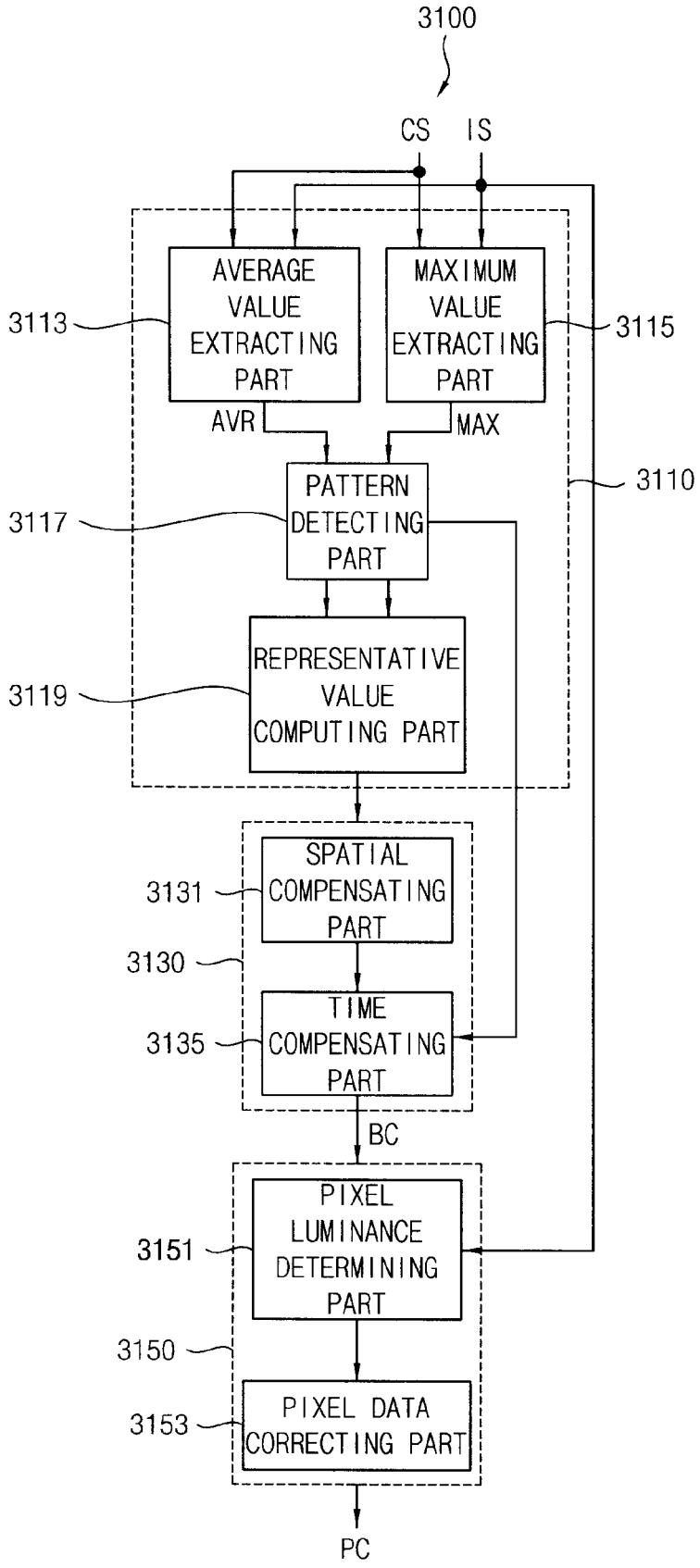
FIG. 3 is a block diagram of an exemplary embodiment of a controller unit of the display apparatus shown in FIG. 2.

FIG. 3 is a block diagram of an exemplary embodiment of the controller unit 3100 of the display apparatus 100 shown in FIGS. 1 and 2.

Referring to FIGS. 2 and 3, the controller unit 3100 according to an exemplary embodiment includes the representative value determining part 3110, the representative value compensating part 3130 and the pixel correcting part 3150.

The representative value determining part 3110 includes an average value extracting part 3113, a maximum value extracting part 3115, a pattern detecting part 3117 and a representative value computing part 3119.

The average value extracting part 3113 obtains an average grayscale value AVR of the luminance of the light-emitting block B based on the image signal IS and the control signal CS, and the maximum value extracting part 3115 obtains a maximum grayscale value MAX of the luminance of the light-emitting block B based on the image signal IS and the control signal CS.

When a frame changes, the pattern detecting part 3117 compares a difference between the average grayscale values AVR of the light-emitting blocks B with a first critical value, and also compares a difference between the maximum grayscale values MAX with a second critical value. The pattern detecting part 3117 detects a predetermined pattern of the light-emitting blocks B. The predetermined pattern represents a rate of change of luminance of the light-emitting block B over a portion of a frame or over a whole frame to compensate the average grayscale value AVR and the maximum grayscale value MAX. Thus, the compensated average grayscale value AVR and the maximum grayscale value are provided to the representative value computing part 3119. Moreover, when the predetermined pattern is detected, the maximum grayscale value MAX and the average grayscale value AVR may be compensated, so that the luminance representative value may be changed corresponding to the average grayscale value AVR regardless of a value of the maximum grayscale value MAX.

The representative value computing part 3119 may determine a specific value between the maximum grayscale value MAX and the average grayscale value AVR of each light-emitting block B as the luminance representative value of the light-emitting block B. For example, the luminance representative value may be a middle grayscale value, e.g., a value between the maximum grayscale value MAX and the average grayscale value AVR of the luminance of the image signal IS included in each light-emitting block B.

The representative value compensating part 3130 may include a spatial compensating part 3131, which, in an exemplary embodiment, is a low-pass filter for filtering the luminance representative value in units of each light-emitting block B. Alternatively, the spatial compensating part 3131 may gradually decrease the luminance representative value of each light-emitting block B by a first transmitting value stage by stage, e.g., in units of stages, with respect to the maximum luminance representative value, as blocks are successively farther away from the light-emitting block B having the maximum luminance representative value.

For example, the luminance representative value of each light-emitting block B may be decreased by the first transmitting value stage by stage with respect to the brightest light-emitting block B. For example, the luminance of a first light-emitting block B adjacent to the brightest light-emitting block B is controlled to not decrease to less than or equal to a first predetermined luminance, and a second light-emitting block B adjacent to the first light-emitting block B is controlled to not decrease to less than or equal to a second predetermined luminance.

When the luminance representative value is compensated by transmitting the luminance of the light-emitting blocks B step by step, a power consumption is substantially reduced as compared to a conventional method of limiting luminance of remaining light-emitting blocks B to predetermined luminances with respect to a luminance of the brightest light-emitting block B.

In addition, the luminance representative value of each light-emitting block B may be compensated by transmitting the luminance of the light-emitting blocks B in a plurality of stages. In this case, a reduction ratio of the luminance of bright light-emitting blocks B is set to be relatively high to further decrease the power consumption, and the reduction ratio of the luminance of dark light-emitting blocks B is set to be relatively low, to effectively prevent a problem of low visibility of a dark object, for example.

The representative value compensating part 3130 may include a time compensating part 3135, which, in an exemplary embodiment, is a low-pass filter for filtering the luminance representative value of each light-emitting block B in frame units of the image signal IS.

When the luminance changes rapidly, such as when displaying a moving image, the luminance of each light-emitting block B between frames of the image signal IS changes rapidly, and a flickering phenomenon in which a glare is visible in the displayed image is generated. In an exemplary embodiment. However, the luminance of each block between frames is controlled so to not changed, by low-pass filtering the luminance representative value of each light-emitting block B at a time axis.

For example, the time compensating part 3135 according to an exemplary embodiment may compensate the luminance of each light-emitting block B based on luminance difference between a previous frame, e.g., an (n−1)-th frame, and a present frame, e.g., an n-th frame.

The representative value compensating part 3130 may include both a spatial compensating part 3131 for low-pass filtering the luminance representative value of each light-emitting block B at a spatial axis and the time compensating part 3135 for low-pass filtering the luminance representative value of each light-emitting block B at the time axis.

The representative value compensating part 3130 compensates each luminance representative value to compute the luminance compensating value, and provides the luminance compensating value to the light source driving part 2200 and the pixel correcting part 3150 as a light source control signal BC. The light source driving part 2200 determines the dimming level of each light-emitting block B with reference to the luminance compensating value. The light source driving part 2200 generates driving signals based on the dimming level and drives the light-emitting blocks B.

The pixel correcting part 3150 increases the luminance of the image by compensating pixel data to compensate for a darkening of the entire screen due to dimming of a backlight. The pixel correcting part 3150 compensates the pixel data of the image signal based on the luminance compensating value provided from the representative value compensating part 3130.

The pixel correcting part 3150 includes a pixel luminance determining part 3151 and a pixel data correcting part 3153.

The pixel luminance determining part 3151 determines the pixel luminance value based on a real operating luminance distribution of the displayed image on the display panel 1100 based on the luminance compensating value.

The pixel data correcting part 3153 corrects the pixel data of the image signal IS based on the pixel luminance value determined at the pixel luminance determining part 3151.

A panel control signal PC, which is the pixel data of the corrected image signal IS, is provided to the panel driving part 1200.

Figure 4:
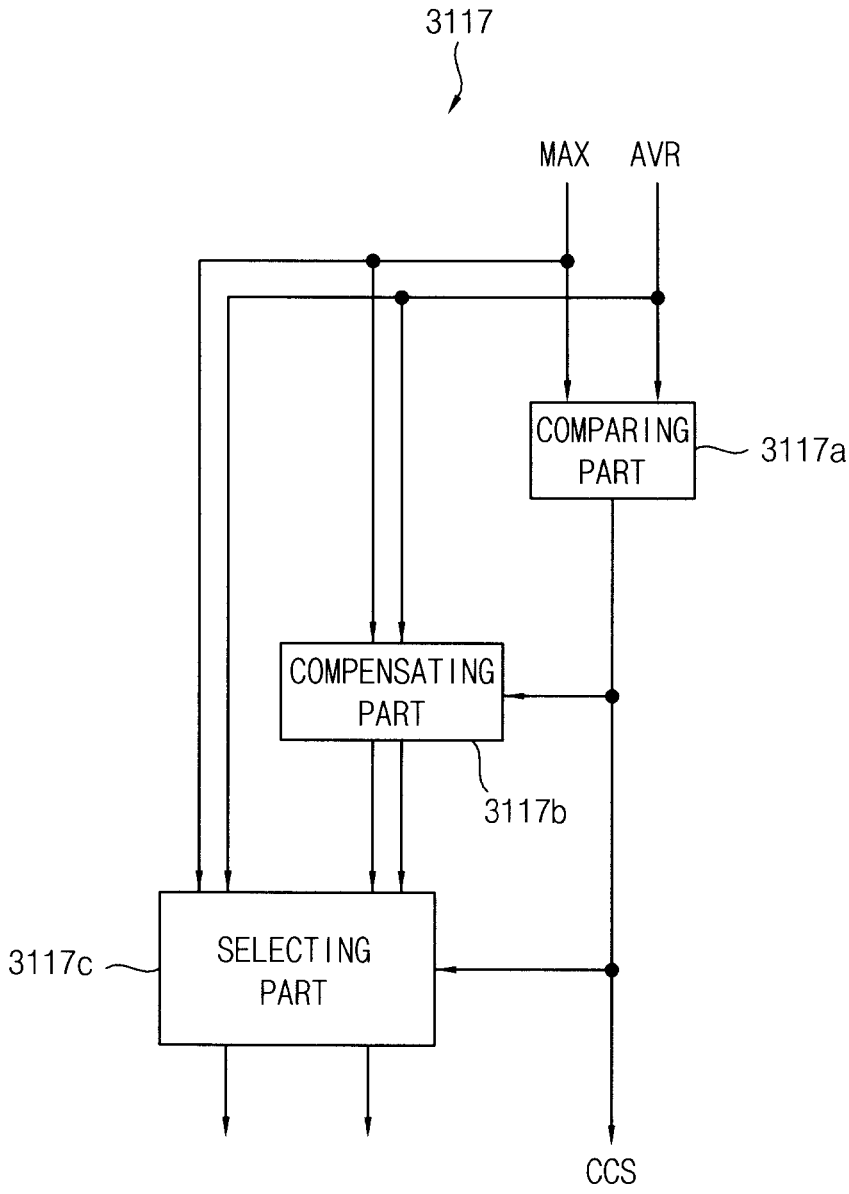
FIG. 4 is a block diagram of an exemplary embodiment of a pattern detecting part of the controller unit shown in FIG. 3.

FIG. 4 is a block diagram of an exemplary embodiment of the pattern detecting part 3117 of the controller unit 3100 shown in FIG. 3.

Referring to FIGS. 3 and 4, the pattern detecting part 3117 includes a comparing part 3117*a*, a compensating part 3117*b* and a selecting part 3117*c*.

The comparing part 3117*a* compares a difference between the average grayscale values AVR and the maximum grayscale values MAX with the first critical value and the second critical value, and outputs a compensation control signal CCS. The compensation control signal CCS is provided to the time compensating part 3135. IN an exemplary embodiment, the compensation control signal CCS is a result of the predetermined pattern detected, and is related to a rapid rate of change of the image luminance displayed on the display panel 1100. For example, when a pattern corresponding to appearing and disappearing subtitles is detected, the comparing part 3117*a* detects the pattern and transitions a level of the compensation control signal CCS.

More specifically, for example, when the difference between the average grayscale value AVR of the light-emitting block B of an n-th frame and the average grayscale value AVR of the light-emitting block B of an (n−1)-th frame is less than the first critical value, and the difference between the maximum grayscale value MAX of the light-emitting block B of the n-th frame and the maximum grayscale value MAX of the light-emitting block B of the (n−1)-th frame is greater than the second critical value, the comparing part 3117*a* transitions the compensation control signal CCS, which is a detecting signal on how rapidly a change of the luminance of the corresponding light-emitting block is increasing, from a low level to a high level and then outputs the compensation control signal CCS having the high level. In an exemplary embodiment, "n" is a natural number greater than or equal to 2.

When the difference between the average grayscale value AVR of the whole n-th frame and the average grayscale value AVR of the whole (n−1)-th frame is less than the first critical value, and the difference between the maximum grayscale value MAX of the whole n-th frame and the maximum grayscale value MAX of the whole (n−1)-th frame is greater than the second critical value, the comparing part 3117*a* transitions the compensation control signal CCS, which is a signal for detecting the rapidly increasing rate of change of the luminance of the n-th frame, from a low level to a high level and then outputs the compensation control signal CCS having the high level.

When the difference between the average grayscale value AVR of the whole n-th frame and the average grayscale value AVR of the whole (n−1)-th frame is less than the first critical value and greater than or equal to zero (0) and the difference between the maximum grayscale value MAX of the light-emitting block B of the n-th frame and the maximum grayscale value MAX of the light-emitting block B of the (n−1)-th frame is greater than the second critical value, the comparing part 3117*a* transitions the compensation control signal CCS, which is a signal for detecting the rapidly increasing change of the luminance of the corresponding light-emitting block B, from a low level to a high level and then outputs the compensation control signal CCS having the high level.

When the compensation control signal CCS has the high level, the rapid change of the luminance of the n-th frame is detected and this detection results in the average grayscale value AVR and the maximum grayscale value MAX being outputted in a compensated state.

When the difference between the average grayscale value AVR of the light-emitting block B of the (n−1)-th frame and the average grayscale value AVR of the light-emitting block B of the n-th frame is less than the first critical value and the difference between the maximum grayscale value MAX of the light-emitting block B of the (n−1)-th frame and the maximum grayscale value MAX of the light-emitting block B of the n-th frame is greater than the second critical value, the comparing part 3117*a* transitions the compensation control signal CCS, which is a now a signal for detecting a rapidly decreasing change of the luminance of the corresponding light-emitting block B, from a high level to a low level and then outputs the compensation control signal CCS having the low level.

When the difference between the average grayscale value AVR of the whole (n−1)-th frame and the average grayscale value AVR of the whole n-th frame is less than the first critical value and the difference between the maximum grayscale value MAX of the whole (n−1)-th frame and the maximum grayscale value MAX of the whole n-th frame is greater than the second critical value, the comparing part 3117*a* transitions the compensation control signal CCS, which is a signal for detecting the rapidly decreasing change of the luminance of the corresponding light-emitting block B, from a high level to a low level and then outputs the compensation control signal CCS having the low level.

In addition, when the difference between the average grayscale value AVR of a whole m-th frame and the average grayscale value AVR of the whole frame right before the rapid increase of the luminance is greater than the first critical value, the comparing part 3117*a* may transition the compensation control signal CCS, which is a signal for detecting the rapidly decreasing change of the luminance of the corresponding m-th frame, from a high level to a low level and then outputs the compensation control signal CCS having the low level. In an exemplary embodiment, the frame immediately before the rapid increase of the luminance represents the frame right before the transition from the low level to the high level of the compensation control signal CCS. In an exemplary embodiment, m is a natural number greater than 2.

When the difference between the average grayscale value AVR of the light-emitting block B of the m-th frame and the average grayscale value AVR of the light-emitting block B of the frame when the luminance rapidly increases to be greater than the first critical value, the comparing part 3117*a* transitions the compensation control signal CCS, which is a signal for detecting a rapidly decreasing rate of change of the luminance of the corresponding light-emitting block B, from a high level to a low level and then outputs the compensation control signal CCS having the low level.

When the difference between the average grayscale value AVR of the light-emitting block B of the m-th frame and the average grayscale value AVR of the light-emitting block B of the frame right before the luminance is rapidly increased to less than the second critical value, the comparing part 3117*a* transitions the compensation control signal CCS, which is a signal for detecting a rapidly decreasing rate of change of the luminance of the corresponding light-emitting block B, from a high level to a low level and then outputs the compensation control signal CCS having the low level.

The compensating part 3117*b* stores the average grayscale value AVR and the maximum grayscale value MAX corresponding to the n-th frame based on the compensation control signal CCS, and compensates the average grayscale value AVR and the maximum grayscale value MAX corresponding to the n-th frame in response to the average grayscale value AVR corresponding to the next frame, e.g., an (n+1)-th frame. For example, the average grayscale value AVR and the maximum grayscale value MAX are compensated so that the luminance of the light source 2100 emitting light in response to the n-th frame is effectively prevented from being rapidly changed.

For example, when a rapidly increasing change in luminance appears over continuous frames, the compensation control signal CCS transitions from a low level to a high level to compensate the average grayscale value AVR and the maximum grayscale value MAX as described herein.

Similarly, when a rapidly decreasing change on the luminance is generated over the continuous frames, the compensation control signal transitions from the high level to the low level so that the luminance representative value may be compensated. More particularly, the luminance representative value may be compensated so that the rate of change of the luminance of the light-emitting block B is decreased to be less than or equal to a predetermined value, e.g., a predetermined velocity.

The selecting part 3117*c* outputs the stored average grayscale value AVR and the maximum grayscale value MAX or outputs the compensated average grayscale value AVR and the maximum grayscale value MAX based on the compensation control signal CCS.

For example, the selecting part 3117*c* outputs the compensated average grayscale value AVR and the maximum grayscale value MAX in response to the compensation control signal CCS at the high level.

Alternatively, when the compensation control signal CCS transitions from the high level to the low level, an initial charging period of the time compensating part 3135 is temporarily changed. More specifically, the initial charging period is a time for buffering the luminance representative value. Thus, when an image is displayed on the display panel 1100 according to the luminance representative value, for example, the time compensating part 3135 does not display the image corresponding to the present frame, e.g., the n-th frame, but instead buffers and displays the image corresponding to the previous frame after a predetermined time. Thus, a rate of change of the luminance of the light source 2100 is further reduced.

The average grayscale value AVR and the maximum grayscale value MAX corresponding to the n-th frame, stored before the compensation according to time may be different from the average grayscale value AVR and the maximum grayscale value MAX after performing the compensation. Thus, an output of the time compensating part 3135 is temporarily changed so that the difference may not be visible as flicker. Therefore, the luminance of the light source 2100 changes gradually.

Figure 5:
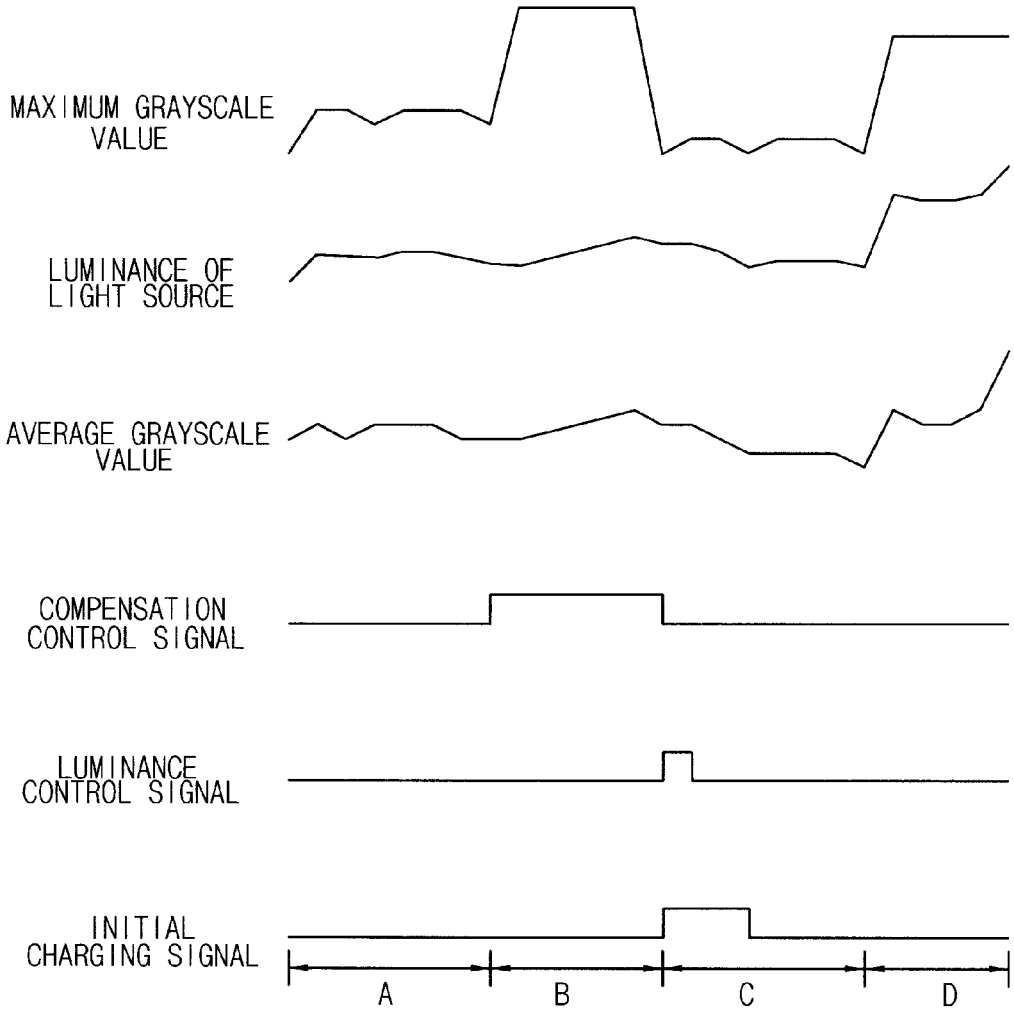
FIG. 5 is a signal timing diagram illustrating input/output signals of a representative value determining part and a representative value compensating part in FIG. 3.

FIG. 5 is a signal timing diagram illustrating input/output signals of an exemplary embodiment of a representative value determining part 3110 and a representative value compensating part 3130 of the controller unit 3100 shown in FIG. 3.

Referring to FIGS. 3 and 5, outputs of the average value extracting part 3113, the maximum value extracting part 3115 and the comparing part 3117*a* will now be described in further detail.

In a period A, the output of the average value extracting part 3113 and the maximum value extracting part 3115, which is the average grayscale value AVR and the maximum grayscale value MAX, does not rapidly change over time, as shown in FIG. 5. Therefore, the compensation control signal CCS, which is outputted by the comparing part 3117*a*, is at a low level.

At a border between the period A and a period B, e.g., at a transition from the period A to the period B, the average grayscale value AVR does not rapidly change, and the difference between the average grayscale values AVR corresponding to the period A and the period B is less than a first critical value. In contrast, the maximum grayscale value MAX rapidly increases, and a difference between the maximum grayscale values MAX corresponding to the period A and the period B is greater than the second critical value. Therefore, the compensation control signal CCS transitions from the low level to the high level.

At a border between the period B and a period C, the maximum grayscale value MAX rapidly decreases less than the maximum grayscale value MAX corresponding to the period A before the beginning of the period B. Therefore, the compensation control signal CCS transitions from the high level to the low level.

At a border between the period C and a period D, the average grayscale value AVR rapidly increases and the maximum grayscale value MAX rapidly increases, and the difference between the average grayscale values AVR and the difference between the maximum grayscale values MAX corresponding to the period A and the period B are greater than the first critical value and the second critical value, respectively. Therefore, the compensation control signal CCS does not transition to the high level but is maintained at the low level, as shown in FIG. 5.

According to an exemplary embodiment, based on a state of the compensation control signal CCS at each period, a luminance representative value compensated by the representative value compensating part 3130 is provided to the light source driving part 2200, and thus the luminance of the light source 2100 is effectively controlled.

In the luminance of the light source 2100, when the compensation control signal CCS is at the low level, a specific value between the average grayscale value AVR and the maximum grayscale value MAX is determined as the luminance representative value. For example, the luminance representative value may be a middle grayscale value between the maximum grayscale value MAX and the average grayscale value AVR of the luminance of the image signal IS included in each image block. Therefore, the luminance of the light source 2100 is the middle grayscale value between the maximum grayscale value MAX and the average grayscale value AVR of the luminance of the image signal IS.

Alternatively, in the luminance of the light source 2100, when the compensation control signal CCS has the high level, the luminance representative value determined after compensating the average grayscale value AVR and the maximum grayscale value MAX is not rapidly changed at the border between the period A and the period B (as is the case for the maximum grayscale value MAX), and slowly changes, e.g., gradually increases, in the period B.

When the compensation control signal CCS transitions from the high level to the low level, the luminance control signal applied to the time compensating part 3135 temporarily becomes a high level.

Referring still to FIG. 5, the initial charging period of the time compensating part 3135 increases as illustrated by the initial charging signal. Therefore, the compensated luminance representative value is buffered during the initial charging period. For example, when the maximum grayscale value MAX rapidly decreases, the luminance of the light source 2100 gradually decreases to effectively prevent a flickering phenomenon.

Figure 6:
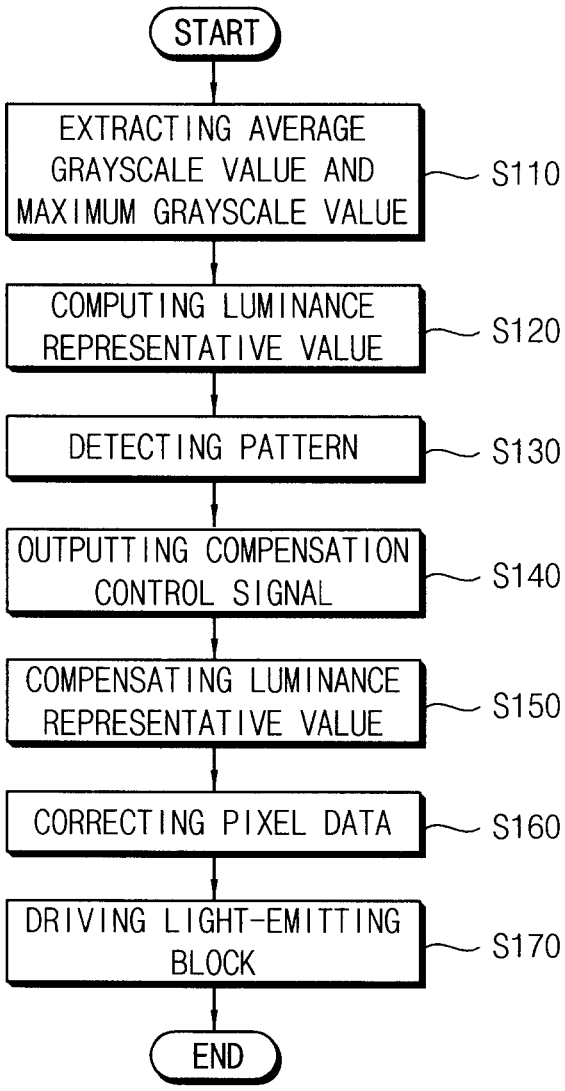
FIG. 6 is a flowchart illustrating an exemplary embodiment of a method of driving a light source of the display apparatus shown in FIG. 2.

FIG. 6 is a flowchart illustrating an exemplary embodiment of a method of driving a light source of the display apparatus shown in FIG. 2.

Referring to FIGS. 2, 3 and 6, the average value extracting part 3113 and the maximum value extracting part 3115 extract the average grayscale value AVR and the maximum grayscale value MAX, respectively, from the image signal IS corresponding to each light-emitting block B including the light source 2100 (step S110).

Then, the representative value computing part 3119 computes the luminance representative value within the range between the average grayscale value AVR and the maximum grayscale value MAX (step S120).

Then, a predetermined pattern is detected from the image signal IS corresponding to each light-emitting bock B (step S130).

Based on the predetermined pattern, the pattern detecting part 3117 outputs the compensation control signal CCS based on the average grayscale value AVR and the maximum grayscale value MAX (step S140).

Then, the representative value compensating part 3130 compensates the luminance representative value in response to the compensation control signal CCS (step S150) to generate a compensated luminance representative value.

The pixel correcting part 3150 corrects the pixel data of the image signal IS based on the compensated luminance representative value (step S160).

Then, the light source driving part 2200 drives each light-emitting block B based on the dimming level at each light-emitting block B corresponding to the compensated luminance representative value (step S170).

Thus, in an exemplary embodiment, when a rapidly increasing change of luminance appears for continuous frames, a flickering phenomenon is substantially reduced and/or is effectively prevented by compensating the average grayscale value AVR and the maximum grayscale value MAX. In addition, when a rapidly decreasing change of the luminance appears for the continuous frames, the flickering phenomenon may be further reduced and/or prevented by increasing an initial charging period of the time compensating part 3135.

Figure 7:
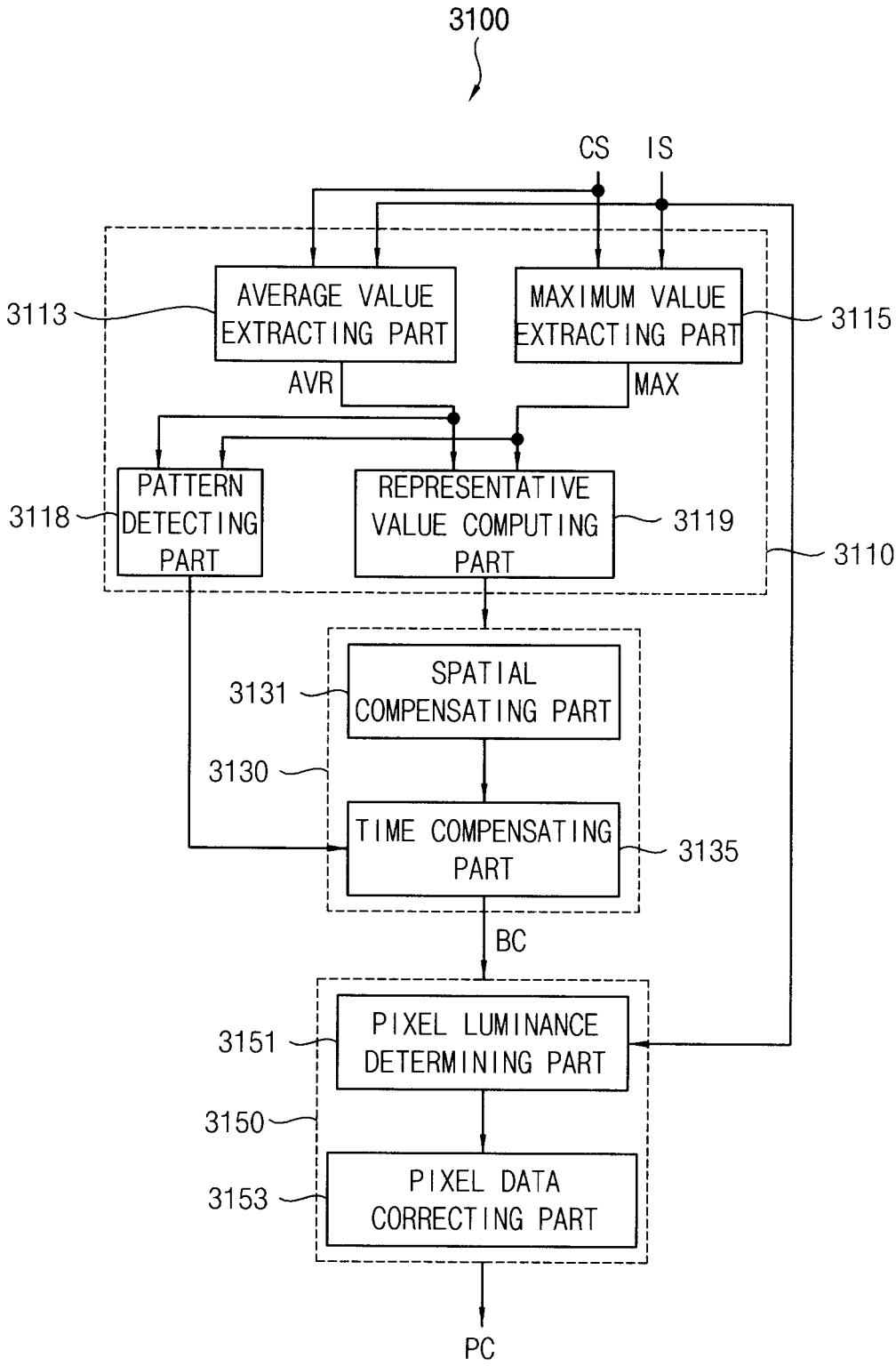
FIG. 7 is a block diagram an alternative exemplary embodiment of a controller unit of the display apparatus shown in FIG. 2.

FIG. 7 is a block diagram of an alternative exemplary embodiment of the controller unit 3100 shown in FIG. 2.

A controller unit 3100 and a display apparatus 100 including the controller unit 3100 according to an alternative exemplary embodiment are substantially the same as the controller unit 3100 and the display apparatus 100 described in further detail above with reference to FIGS. 1-6 except for a pattern detecting part 3118, for example. Therefore, the same reference characters are used for corresponding elements in FIGS. 7-9, and any repetitive detailed description thereof will hereinafter be omitted.

Referring to FIGS. 2 and 7, the controller unit 3100 according to an alternative exemplary embodiment includes a representative value determining part 3110, a representative value compensating part 3130 and a pixel correcting part 3150.

The representative value determining part 3110 includes an average value extracting part 3113, a maximum value extracting part 3115, a pattern detecting part 3118 and a representative value computing part 3119.

The pattern detecting part 3118 compares a difference between average grayscale values AVR for a light-emitting block B or, alternatively, for a frame, and maximum grayscale values MAX for the light-emitting block B or, alternatively, for the frame, with the first critical value and the second critical value, respectively, and outputs a rapid change of the luminance of the light-emitting block B (or the frame). Based on the detection result, the pattern detecting part 3118 provides a compensation control signal to the representative value compensating part 3130, and the representative value compensating part 3130 compensates the luminance representative value. The time compensating part 3135 included in the representative value compensating part 3130 increases an initial charging period based on the compensation control signal. Therefore, a rapid change of luminance of the light source 2100 at a given point in time is reduced and/or is effectively prevented, thereby substantially reducing and/or effectively preventing flickering.

Figure 8:
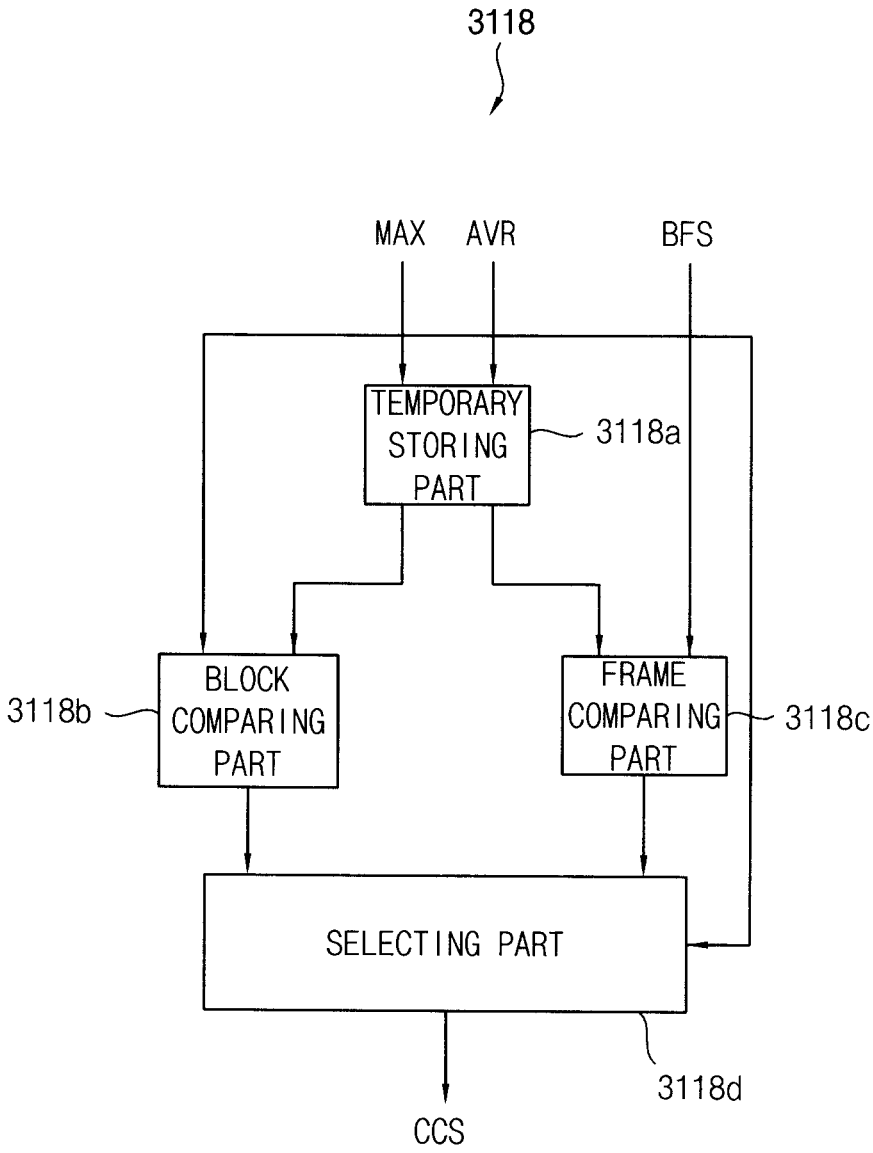
FIG. 8 is a block diagram an exemplary embodiment of a pattern detecting part of the controller unit shown in FIG. 7.

FIG. 8 is a block diagram of an exemplary embodiment of the pattern detecting part 3118 of the controller unit 3100 shown in FIG. 7.

Referring to FIGS. 7 and 8, the pattern detecting part 3118 includes a temporary storing part 3118*a*, a block comparing part 3118*b*, a frame comparing part 3118*c* and a selecting part 3118*d*.

The temporary storing part 3118*a* receives the average grayscale value AVR and the maximum grayscale value MAX of an n-th frame, and stores and outputs the average grayscale value AVR and the maximum grayscale value MAX of the light-emitting block B or stores, or, alternatively, outputs the average grayscale value AVR and the maximum grayscale value MAX of the whole n-th frame.

The block comparing part 3118*b* receives the average grayscale value AVR and the maximum grayscale value MAX of the light-emitting block B of the n-th frame, and outputs a block compensation control signal BCS in response to a block/frame selecting signal BFS. In an exemplary embodiment, the block comparing part 3118*b* compares the difference between the average grayscale values AVR by the light-emitting block B and the maximum grayscale values MAX by the light-emitting block B with a first critical value and a second critical value, respectively, and detects a rapid change of the luminance of the light-emitting block B.

The frame comparing part 3118*c* receives the average grayscale value AVR and the maximum grayscale value MAX of the whole n-th frame and outputs a frame compensation control signal FCS in response to the block/frame selecting signal BFS. In an exemplary embodiment, the frame comparing part 3118*c* compares the difference between the average grayscale values AVR by the frame and the maximum grayscale values MAX by the frame with the first critical value and the second critical value, and thereby detects the rapid change of the luminance of the frame.

More specifically, for example, when the difference between the average grayscale value AVR of the light-emitting block B of the n-th frame and the average grayscale value AVR of the light-emitting block B of the (n−1)-th frame is less than the first critical value, and the difference between the maximum grayscale value MAX of the light-emitting block B of the n-th frame and the maximum grayscale value MAX of the light-emitting block B of the (n−1)-th frame is greater than the second critical value, the comparing part 3117*a* transitions the block compensation control signal BCS, which is a signal for detecting the rapidly increasing change of the luminance of the corresponding light-emitting block B, from a low level to a high level, and then outputs the block compensation control signal BCS having the high level.

When the difference between the average grayscale value AVR of the whole n-th frame and the average grayscale value AVR of the whole (n−1)-th frame is less than the first critical value, and the difference between the maximum grayscale value MAX of the whole n-th frame and the maximum grayscale value MAX of the whole (n−1)-th frame is greater than the second critical value, the comparing part 3117*a* transitions the frame compensation control signal FCS, which is a signal for detecting the rapidly increasing change of the luminance of the corresponding (n−1)-th frame, from a low level to a high level, and then outputs the frame compensation control signal FCS having the high level.

When the difference between the average grayscale value AVR of the whole n-th frame and the average grayscale value AVR of the whole (n−1)-th frame is less than the first critical value and greater than or equal to zero (0), and the difference between the maximum grayscale value MAX of the light-emitting block B of the n-th frame and the maximum grayscale value MAX of the light-emitting block B of the (n−1)-th frame is greater than the second critical value, the comparing part 3117*a* transitions the block compensation control signal BCS, which is a signal for detecting of the rapidly increasing change of the luminance of the corresponding light-emitting block B, from a low level to a high level and, then outputs the block compensation control signal BCS having the high level.

When the block compensation control signal BCS or the frame compensation control signal FCS has the high level, the rapidly increasing change of the luminance of the n-th frame is detected and the average grayscale value AVR and the maximum grayscale value MAX are therefore compensated, as described above.

When the difference between the average grayscale value AVR of the light-emitting block B of the (n−1)-th frame and the average grayscale value AVR of the light-emitting block B of the n-th frame is less than the first critical value, and when the difference between the maximum grayscale value MAX of the light-emitting block B of the (n−1)-th frame and the maximum grayscale value MAX of the light-emitting block B of the n-th frame is greater than the second critical value, the comparing part 3117*a* transitions the block compensation control signal BCS, which is a signal for detecting the rapidly decreasing change of the luminance of the corresponding light-emitting block B, from a high level to a low level, and then outputs the block compensation control signal BCS having the low level.

When the difference between the average grayscale value AVR of the whole (n−1)-th frame and the average grayscale value AVR of the whole n-th frame is less than the first critical value, and the difference between the maximum grayscale value MAX of the whole (n−1)-th frame and the maximum grayscale value MAX of the whole n-th frame is greater than the second critical value, the comparing part 3117*a* transitions the block compensation control signal BCS, which is a signal for detecting the rapidly decreasing change of the luminance of the corresponding light-emitting block B, from a high level to a low level and then outputs the block compensation control signal BCS having the low level.

In addition, when the difference between the average grayscale value AVR of the whole m-th frame and the average grayscale value AVR of the whole frame right before the rapid increase of the luminance is greater than the first critical value, the comparing part 3117*a* transitions the frame compensation control signal FCS, which is a signal for detecting the rapidly decreasing change of the luminance of the corresponding m-th frame from a high level to a low level, and then outputs the frame compensation control signal FCS having the low level. In an exemplary embodiment, the frame before, e.g., prior to and, more particularly, immediately adjacent to and preceding, the rapid increasing of the luminance corresponds to the frame before the transition of the block compensation control signal BCS or the frame compensation control signal FCS from the low level to the high level.

When the difference between the average grayscale value AVR of the light-emitting block B of the m-th frame and the average grayscale value AVR of the light-emitting block of the frame right before the rapid increasing of the luminance is greater than the first critical value, the comparing part 3117*a* transitions the block compensation control signal BCS, which is a signal for detecting the rapidly decreasing change of the luminance of the corresponding light-emitting block B, from the high level to the low level and then outputs the block compensation control signal BCS having the low level.

When the difference between the maximum grayscale value MAX of the light-emitting block B of the m-th frame and the maximum grayscale value MAX of the light-emitting block B of the frame right when the luminance is rapidly heightened is less than the second critical value, the comparing part 3117*a* transitions the block compensation control signal BCS, which is a signal for detecting the rapidly decreasing change of the luminance of the corresponding light-emitting block B, from the high level to the low level and then outputs the block compensation control signal BCS having the low level.

The selecting part 3118*d* receives the block compensation control signal BCS and the frame compensation control signal FCS, and outputs one of the block compensation control signal BCS and the frame compensation control signal FCS in response to the block/frame selecting signal BFS, as the compensation control signal CCS. Here, the compensation control signal CCS is provided to the time compensating part 3135 to control the time compensating part 3135.

When the luminance of the light-emitting block B of the n-th frame or the luminance of the whole n-th frame rapidly increases, the block compensation control signal BCS or the frame compensation control signal FCS transitions from the low level to the high level. Thus, the compensation control signal CCS transitions from the low level to the high level.

When the compensation control signal CCS transitions from the low level to the high level, the time compensating part 3135, provided with the compensation control signal CCS, increases the initial charging period, thereby effectively preventing the rapid change of the luminance of the light-emitting block B and the frame. Therefore, the luminance of the light source 2100 according to an exemplary embodiment gradually changes. Accordingly, flickering is substantially reduced and/or is effectively prevented in the display apparatus 100 according to an exemplary embodiment.

Figure 9:
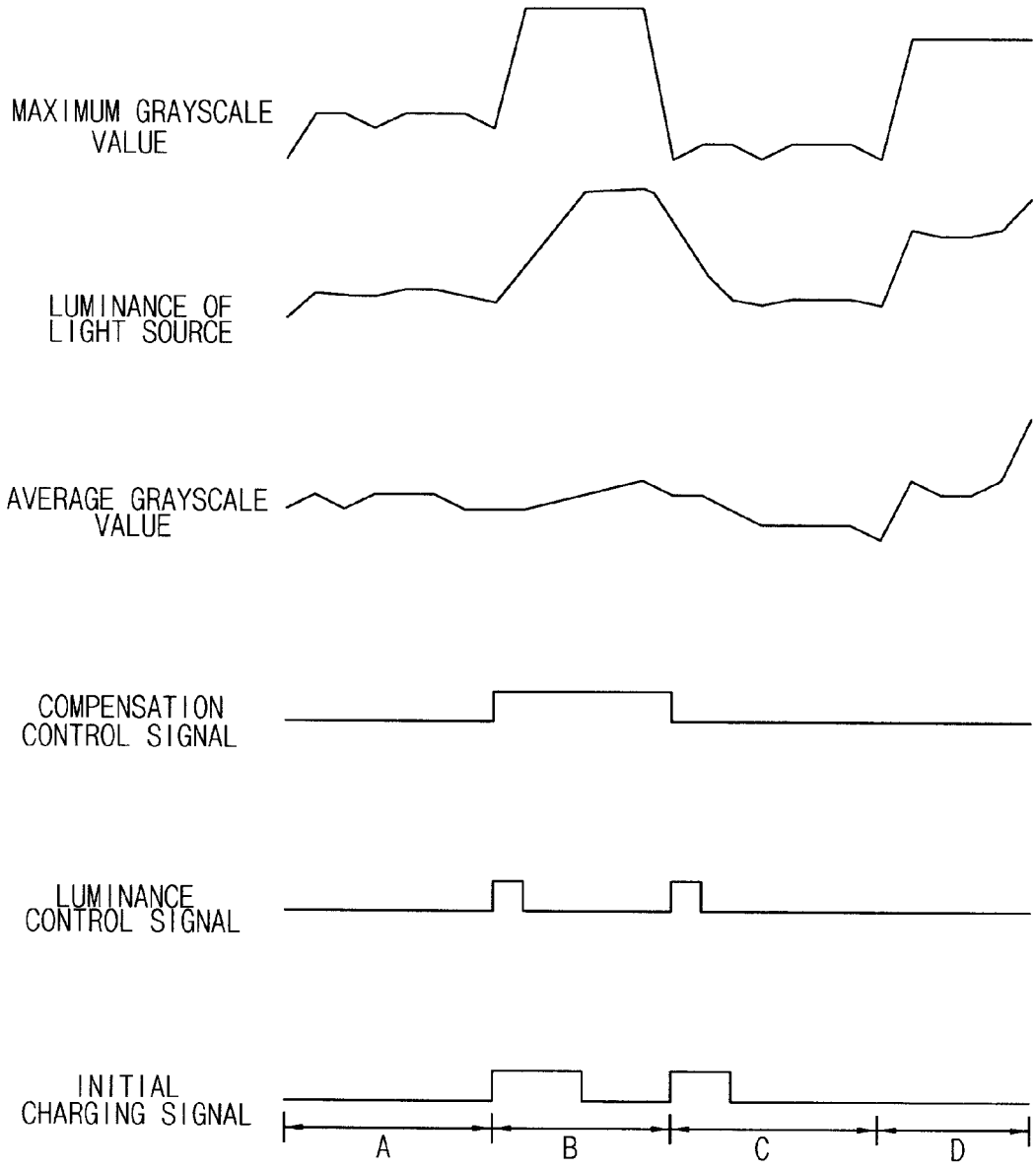
FIG. 9 is a signal timing diagram of input/output signals of an exemplary embodiment of a representative value determining part and a representative value compensating part of the controller unit shown in FIG. 7.

FIG. 9 is a signal timing diagram illustrating input/output signals of an alternative exemplary embodiment of a representative value determining part 3110 and a representative value compensating part 3130 of the controller unit 3100 shown in FIG. 7.

Referring to FIGS. 7 to 9, outputs of the average value extracting part 3113, the maximum value extracting part 3115 and the selecting part 3118*d* will now be described in further detail.

During a period A, the average grayscale value AVR and the maximum grayscale value MAX, which are outputs of the average value extracting part 3113 and the maximum value extracting part 3115, respectively, are not rapidly changing. Therefore, the compensation control signal CCS, outputted from the selecting part 3118*d*, has a low level.

At a border between the period A and a period B, the average grayscale value AVR is not rapidly changing and the difference between the average grayscale values AVR corresponding to the period A and the period B is therefore less than a first critical value. In contrast, the maximum grayscale value MAX is rapidly increasing, and the difference between the maximum grayscale value MAX corresponding to the period A and the period B is greater than a second critical value. Therefore, the compensation control signal CCS transitions from the low level to the high level, as shown in FIG. 9.

At a border between the period B and a period C, the maximum grayscale value MAX is decreasing rapidly and therefore becomes less than the maximum grayscale value MAX corresponding to the period A before the beginning of the period B. Therefore, the compensation control signal CCS transitions from the high level to the low level.

At a border between the period C and a period D, the average grayscale value AVR is rapidly increasing and the maximum grayscale value MAX is also rapidly increasing, and thus the difference between the average grayscale value AVR and the difference between the maximum grayscale value MAX corresponding to the period A and the period B are greater than the first critical value and the second critical value. Therefore, the compensation control signal CCS does not transition to the high level but remains at the low level.

Thus, according to a state of the compensation control signal CCS at each period, the luminance representative value compensated by the representative value compensating part 3130 is provided to the light source driving part 2200, and thus the luminance of the light source 2100 according to an exemplary embodiment is effectively controlled.

For the luminance of the light source 2100, a specific value between the average grayscale value AVR and the maximum grayscale value MAX may be determined as the luminance representative value when the compensation control signal CCS is at the low level. For example, the luminance representative value may be a middle grayscale value, e.g., a level between the maximum grayscale value MAX and the average grayscale value AVR of the luminance of the image signal IS included in each image block. Therefore, the luminance of the light source 2100 follows the middle grayscale value between the maximum grayscale value MAX and the average grayscale value AVR of the luminance of the image signal IS.

Alternatively, for the luminance of the light source 2100 when the compensation control signal CCS is at the high level, the luminance control signal applied to the time compensating part 3135 temporarily becomes the high level.

In addition, at when the compensation control signal CCS transitions from the high level to the low level, the luminance control signal applied to the time compensating part 3135 temporarily becomes the high level.

Therefore, as illustrated by the initial charging signal, the initial charging period of the time compensating part 3135 increases. Accordingly, the compensated luminance representative value is buffered during the initial charging period. Specifically, for example, when the maximum grayscale value MAX is rapidly increasing (or, alternatively, is rapidly decreasing) the luminance of the light source 2100 is slowly increased (or decreased) to effectively prevent flickering in the display apparatus 100 according to an exemplary embodiment.

A driving method of the light source in accordance with the exemplary embodiment shown in FIG. 7-9 is substantially the same as the exemplary embodiment of driving method of the light source in accordance with the exemplary embodiment in shown in FIGS. 1-6, and thus any repetitive detailed description thereof has been omitted.

Thus, according exemplary embodiments described herein, when a rapidly increasing change rate (or a rapidly decreasing change rate) of a luminance of continuous frames occurs, a flickering phenomenon is substantially reduced and/or is effectively prevented by increasing an initial charging period of a time compensating part.

In addition, since an average grayscale value AVR and a maximum grayscale value MAX are not required to be compensated, the display apparatus 100 according to an exemplary embodiment is simpler.

Therefore, in accordance with exemplary embodiments of the present invention, a flickering phenomenon is substantially reduced and/or effectively prevented when a luminance of a light-emitting block of continuous frames rapidly increases or decreases by compensating an average grayscale value and a maximum grayscale value or by controlling a time compensating part.

The present invention should not be construed as being limited to the exemplary embodiments set forth herein. Rather, these exemplary embodiments are provided so that this disclosure will be thorough and complete and will fully convey the concept of the present invention to those skilled in the art.

The description herein is illustrative of exemplary embodiments of the present invention and is not to be construed as limiting thereof. Although exemplary embodiments of the present invention have been particularly shown described, it will be understood by those of ordinary skill in the art that various changes and modifications in form and details therein are possible without departing from the spirit or scope of the present invention as defined by the following claims.

What is claimed is:

1. A method of driving a light source including a light-emitting block, the method comprising:

generating a luminance representative value based on an average grayscale value and a maximum grayscale value extracted from an image signal corresponding to the light-emitting block;

detecting a predetermined pattern of the light-emitting block, based on the average grayscale value and the maximum grayscale value;

generating a compensation control signal based on the predetermined pattern;

generating a compensated luminance representative value by compensating the luminance representative value based on the compensation control signal; and driving the light-emitting block based on a luminance level of the light-emitting block corresponding to the compensated luminance representative value.

2. The method of claim 1, wherein the detecting the predetermined pattern comprises:

comparing a difference between the average grayscale value of an n-th frame and an (n−1)-th frame with a first critical value; and comparing a difference between a maximum grayscale value of the n-th frame and the (n--1)-th frame with a second critical value, wherein n is a natural number greater than or equal to 2.

3. The method of claim 2, wherein the detecting the predetermined pattern further comprises:

comparing a difference between an average grayscale value of an m-th frame, in which the compensation control signal has a high level, and the average grayscale value extracted from the image signal before the compensation control signal transitions from a low level to the high level with the first critical value; and comparing a difference between a maximum grayscale value of the m-th frame and the maximum grayscale value extracted from the image signal when the compensation control signal transitions from the low level to the high level with the second critical value, wherein m is a natural number greater than 2.

4. The method of claim 3, wherein the luminance representative value is compensated such that a rate of decrease of a luminance of the light source is less than or equal to a predetermined value.

5. The method of claim 3, wherein the luminance representative value is compensated such that a luminance of the light source changes based on the average grayscale value extracted from the image signal regardless of a value of the maximum grayscale value extracted therefrom.

6. A light source apparatus comprising:

a backlight unit including a light-emitting block, the light-emitting block including a light source;

a representative value determining part which generates a compensation control signal by determining a luminance representative value based on an average grayscale value and a maximum grayscale value extracted from an image signal corresponding to the light-emitting block and detecting a predetermined pattern of the light-emitting block based on the average grayscale value and the maximum grayscale value;

a representative value compensating part which compensates the luminance representative value in response to the compensation control signal to generate a compensated luminance representative value; and a light source driving part which drives the light-emitting block based on a luminance level of the light-emitting block corresponding to the compensated luminance representative value.

7. The light source apparatus of claim 6, wherein the representative value determining part comprises:

an average value extracting part which extracts the average grayscale value from the image signal;

a maximum value extracting part which extracts the maximum grayscale value from the image signal;

a pattern detecting part which generates the compensation control signal by detecting the predetermined pattern based on the average grayscale value and the maximum grayscale value extracted from the image signal; and a representative value computing part which computes the luminance representative value.

8. The light source apparatus of claim 7, wherein the pattern detecting part comprises:

a comparing part which generates the compensation control signal by comparing a difference between average grayscale values of an n-th frame and an (n−1)-th frame with a first critical value, and a difference between maximum grayscale values of the n-th frame and the (n−1)-th frame with a second critical value, wherein n is a natural number greater than or equal to 2;

a compensating part which compensates the average grayscale value and the maximum grayscale value extracted from the image signal based on the average grayscale value and the maximum grayscale value of the n-th frame in response to the compensation control signal; and a selecting part which selects and outputs the compensated average grayscale value and the maximum grayscale value based on the compensation control signal.

9. The light source apparatus of claim 8, wherein the comparing part is configured to transition the compensation control signal from a low level to a high level and outputs the compensation control signal having the high level when the difference between the average grayscale values is less than the first critical value and the difference between the maximum grayscale values is greater than the second critical value.

10. The light source apparatus of claim 9, wherein the representative value compensating part is configured to compensate the average grayscale value and the maximum grayscale value such that a luminance of the backlight unit changes based on the average grayscale value extracted from the image signal regardless of a value of the maximum grayscale value when the compensation control signal transitions from the low level to the high level.

11. The light source apparatus of claim 9, wherein the comparing part is configured to transition the compensation control signal from the high level to the low level and output the compensation control signal having the low level when the difference between the average grayscale values is greater than the first critical value and the difference between the maximum grayscale value is less than the second critical value.

12. The light source apparatus of claim 11, wherein the representative value compensating part is configured to increase an initial charging period when the compensation control signal transitions from the high level to the low level, and to buffer the luminance representative value during the initial charging period to decrease luminance of the backlight unit at a rate which is less than or equal to a predetermined value.

13. The light source apparatus of claim 8, wherein the comparing part is configured to compare a difference between an average grayscale value of an m-th frame and the average grayscale value extracted from the image signal before the compensation control signal transitions from a low level to a high level with the first critical value, and to compare a difference between the maximum grayscale value of the m-th frame and the maximum grayscale value extracted from the image signal when the compensation control signal transitions from the low level to the high level with the second critical value when the compensation control signal has the high level, wherein m is a natural number greater than 2.

14. The light source apparatus of claim 13, wherein the comparing part is configured to generate the compensation control signal when one of the difference between the average grayscale value of the m-th frame and the average grayscale value before the compensation control signal transitions from the low level to the high level are greater than the first critical value, and the difference between the maximum grayscale value of the m-th frame and the maximum grayscale value right before the compensation control signal transitions from the low level to the high level are less than the second critical value.

15. The light source apparatus of claim 14, wherein the representative value compensating part is configured to increase an initial charging period when the compensation control signal transitions from the high level to the low level and buffer the luminance representative value during the initial charging period to decrease a luminance of the backlight unit at a rate which is less than or equal to a predetermined value.

16. The light source apparatus of claim 7, wherein the pattern detecting part comprises:

a temporary storing part which stores and outputs average grayscale values of an n-th frame and an (n−1)-th frame, where n is a natural number greater than or equal to 2, and maximum grayscale values of the n-th frame and the (n−1)-th frame based on one of blocks and frames;

a block comparing part which receives the average grayscale values and the maximum grayscale values corresponding to the light-emitting block from the temporary storing part, and generates a block compensation control signal based on a block/frame selecting signal;

a frame comparing part which receives the average grayscale values and the maximum grayscale values, corresponding to frames, from the temporary storing part, and generates a frame compensation control signal based on the block/frame selecting signal; and a selecting part which selects one of the block compensation control signal and the frame compensation control signal based on the block/frame selecting signal, and outputs the one of the block compensation control signal and the frame compensation control signal.

17. A display apparatus comprising:

a light source apparatus comprising:

a backlight unit including a light-emitting block, the light-emitting block including a light source;

a representative value determining part which determines a luminance representative value based on an average grayscale value and a maximum grayscale value extracted from an image signal corresponding to the light-emitting block, which detects a predetermined pattern of the light-emitting block based on the average grayscale value and the maximum grayscale value extracted from the image signal corresponding to the light-emitting block, and which generates a compensation control signal;

a representative value compensating part which compensates the luminance representative value based on the compensation control signal to generate a compensated luminance representative value;

a pixel correcting part which corrects pixel data of the image signal based on the compensated luminance representative value to generate corrected pixel data; and a light source driving part which drives the light-emitting block based on a luminance level of the light-emitting block corresponding to the compensated luminance representative value; and a display unit including a display panel and a panel driving part which drives the display panel using the corrected pixel data.

18. The display apparatus of claim 17, wherein the pixel correcting portion comprises:

a pixel luminance determining part which computes a real luminance distribution of the image signal based on the compensated luminance representative value, and which determines a pixel luminance value therefrom; and a pixel data correcting part which corrects the pixel data based on the pixel luminance value determined by the pixel luminance determining part.

* * * * *